US005138716A

United States Patent [19]

Deuschle

[11] Patent Number: 5,138,716

[45] Date of Patent: Aug. 18, 1992

[54] JACKET CONSTRUCTION AND METHOD OF MAKING A JACKET

[75] Inventor: Elizabeth Deuschle, Rohrbach, Fed. Rep. of Germany

[73] Assignee: Robert J. Nani, Birmingham, Mich.

[21] Appl. No.: 487,795

[22] Filed: Mar. 5, 1990

[51] Int. Cl.[5] ..... A41D 1/02; A41D 1/00; A41D 10/00

[52] U.S. Cl. ..... 2/108; 2/85; 2/93; 2/243 R; 2/243 B

[58] Field of Search ..... 2/108, 243 R, 243 B, 2/85, 93

[56] References Cited

U.S. PATENT DOCUMENTS 4,821,343 4/1989 Quealy ..... 2/102

*Primary Examiner*—Werner H. Schroeder
*Assistant Examiner*—Gloria Hale
*Attorney, Agent, or Firm*—Daniel H. Bliss

[57] ABSTRACT

A jean jacket is developed by maximizing use of selected seamed components from three pairs of jean-type pants with minimized cutting and alteration. A first component forming the rear and side panels and shoulders of the jacket is made from a first pair of jeans. The collar, sleeves and top front panels are made from a second pair of jeans patterned and sewn to the first component and the front chest and waist portion with existing belt band and front pockets is made from a third pair of jeans sewn to the top front and side panels.

4 Claims, 4 Drawing Sheets

JACKET CONSTRUCTION AND METHOD OF MAKING A JACKET

TECHNICAL FIELD

This invention relates to clothing articles and, more particularly, to a new and improved jacket and to a method of making a jacket from a number of pairs of trousers.

BACKGROUND ART

Various articles of clothing adapted to fit one part of the human body have been modified to fit another part of the body. For example, in Quealy U.S. Pat. No. 4,821,343 issued Apr. 18, 1989, an undergarment with leg openings designed to closely fit the lower torso of a human body is modified by providing a neck opening between the leg openings so that it can be worn on the upper torso. A variety of other clothing articles have also been made from bolt ends, scraps and components of different garments.

The present invention is of the general category of that of the Quealy U.S. Pat. No. 4,821,343 and prior methods identified above, but provides a new and improved jacket construction and optimized method of making a jacket basically transformed from a number of pairs of trousers which may be either new or worn and can be of different sizes and makes. Preferably, in this invention, three pairs of trousers in the form of jeans, substantially identical in style and size are developed into a single jacket. In this invention, various selected seams of the pairs of trousers are ripped while the trousers having parts still seamed together are laid out and cut in a manner so that they can be utilized as components of the jacket. The number of cuts in existing trousers is minimized so that complete portions thereof can be utilized as complete portions of the jacket.

In a preferred embodiment of this invention, a first pair of trousers is seam ripped at the leg inseams and cut and reseamed at a centralized back seam to form the back, sides and shoulders of the jacket. Components of a second pair of trousers are utilized as a collar, sleeve and front portions the jacket while components of a third pair of trousers are employed as a pocketed lower front of the jacket.

It is a feature, object and advantage of this invention to provide a new and improved method of making a jacket from pairs of trousers in which one of the pairs of trousers is parted at the inseam of the legs, spread apart, selectively cut and resewn to form a major component of the jacket while the legs and waistband of another pair of trousers are used for the arms, sleeves and collar of the jacket and front panels from a third pair of trousers are used for the waist and front panels of the jacket.

Another feature, object and advantage of this invention is to provide a new and improved method of making a jacket from components of pairs of trousers in which the major components of the jacket are formed from selected components of the trousers, including the transformation of one pair of trousers into the back sides and shoulders of the jacket and with sleeves, neck collar and front panels made from components of other pairs of trousers.

Another feature, object and advantage of this invention is to provide a new and improved jacket developed from pairs of jeans while maximum utilization of components of the jeans exemplified by transforming (1) the waistband and front of a first pair of jeans as the jacket belt band and pocketed front panels, (2) another pair of jeans as the back and side panels of the jacket and (3) the waistband and legs of yet another pair of jeans as the collar and arms of the jacket.

DETAILED DESCRIPTION OF THE DRAWINGS

Figure 1:
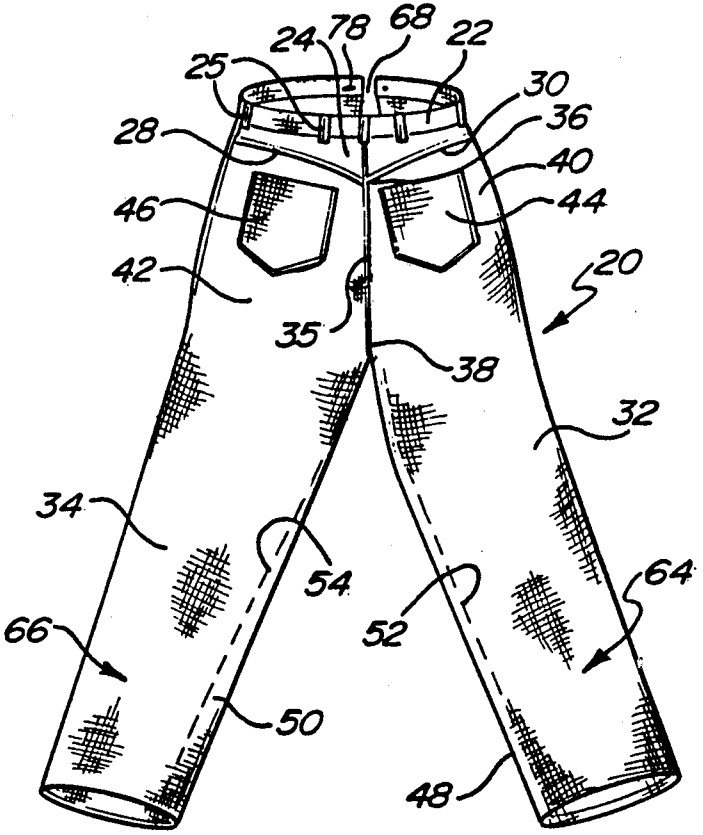
FIG. 1 is a pictorial view of a pair of trousers from the rear.

Turning now in greater detail to the drawings, FIG. 1 illustrates from the rear a first pair of trousers 20 preferably those known as "jeans" and of a fabric such as denim, chino or poplin having a circular waistband 22 to which a two-piece V-shaped back yoke 24 is sewn. Carriers 25 are provided to accommodate a belt of the wearer.

Straight stitched at seams 28 and 30 to the V-shaped bottom edges of the back yoke are upper edges of elongated right and left rear panels 32 and 34. These two panels are straight stitched together at seam 35 from an apex 36 of the back yoke to a crotch point 38. The seat portions 40 and 42 of these panels are provided with patch type pockets 44 and 46 sewn thereto.

Right and left front panels 48, 50, only partially shown in FIG. 1, are respectively connected by sewn inseams 52, 54 to the rear panels 32, 34 from crotch point 38 to the respective lower cuff ends of these panels. Outer seams 58 and 60, shown in FIG. 2, leading from the cuff end of the front and rear panels along the opposite and outer side edges thereof up to the waistband 22 are sewn to complete open ended right and left legs 64 and 66.

Figure 2:
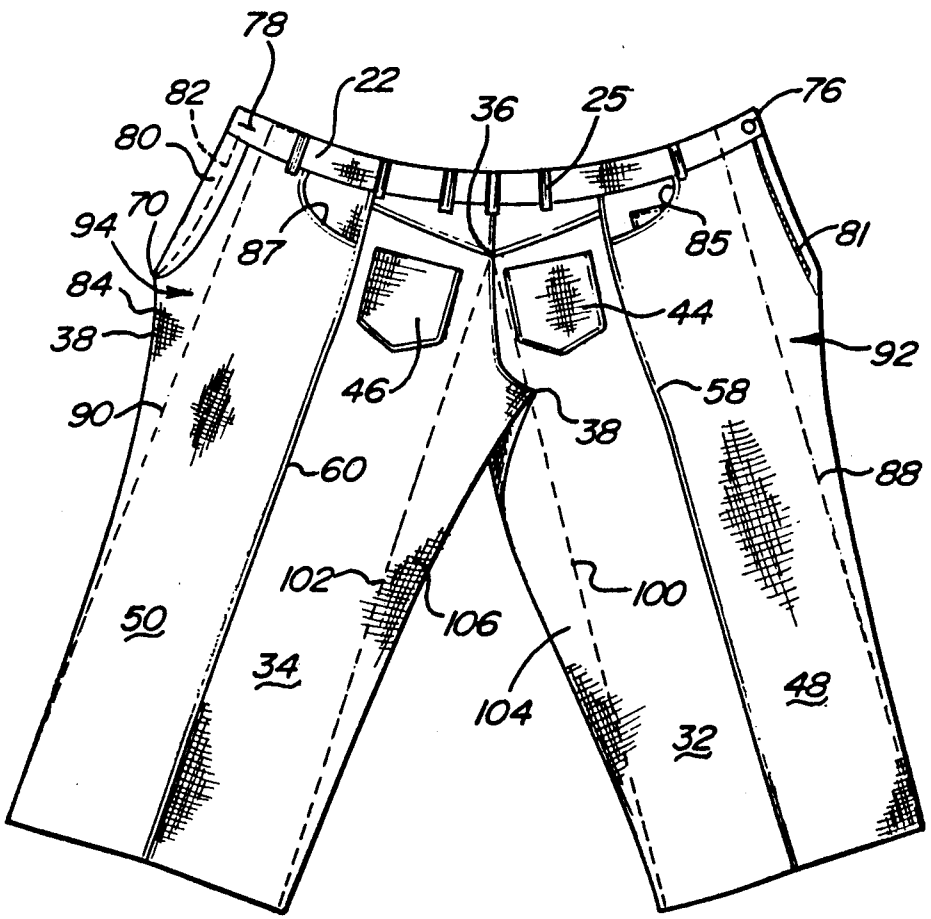
FIG. 2 is a plan view of the trousers of FIG. 1 showing the front and rear panels laid out after the inseams of the leg panels have been parted.

An elongated front access opening 68 shown in Fig. 1 extends from waistband 22 to conventional front bar stitching 70, shown in FIG. 2, above the crotch point 38 to allow the jeans to be opened such as for dressing purposes. A front button 76 cooperates with button hole 78 on the waistband and zipper type closure halves 80, 81 extend from the bar stitching 70 to the waistband and, when closed, are hidden by left front facing 82 allowing convenient opening and closing of the front access opening 68. From bar stitching 70 to the crotch point 38 the jeans are sewn together at a frontal seam 84. Right and left front pockets 85 and 87 are provided in the upper end of the right and left front panels.

In making the jean jacket of this invention, the leg inseams 52, 54 and frontal seam 84 are ripped to crotch point 38 and the jeans 20 are unfolded into the FIG. 2 position. Elongated chalk lines 88 and 90 are marked near the outer edges of front panels 48 and 50 and surplus front portion 92, 94 including the zipper closure halves 80, 81 are cut away along those line to leave substantially straight raw edges 96 and 98 shown in FIG. 3.

Figures 3, 4, 5, 6, 7:
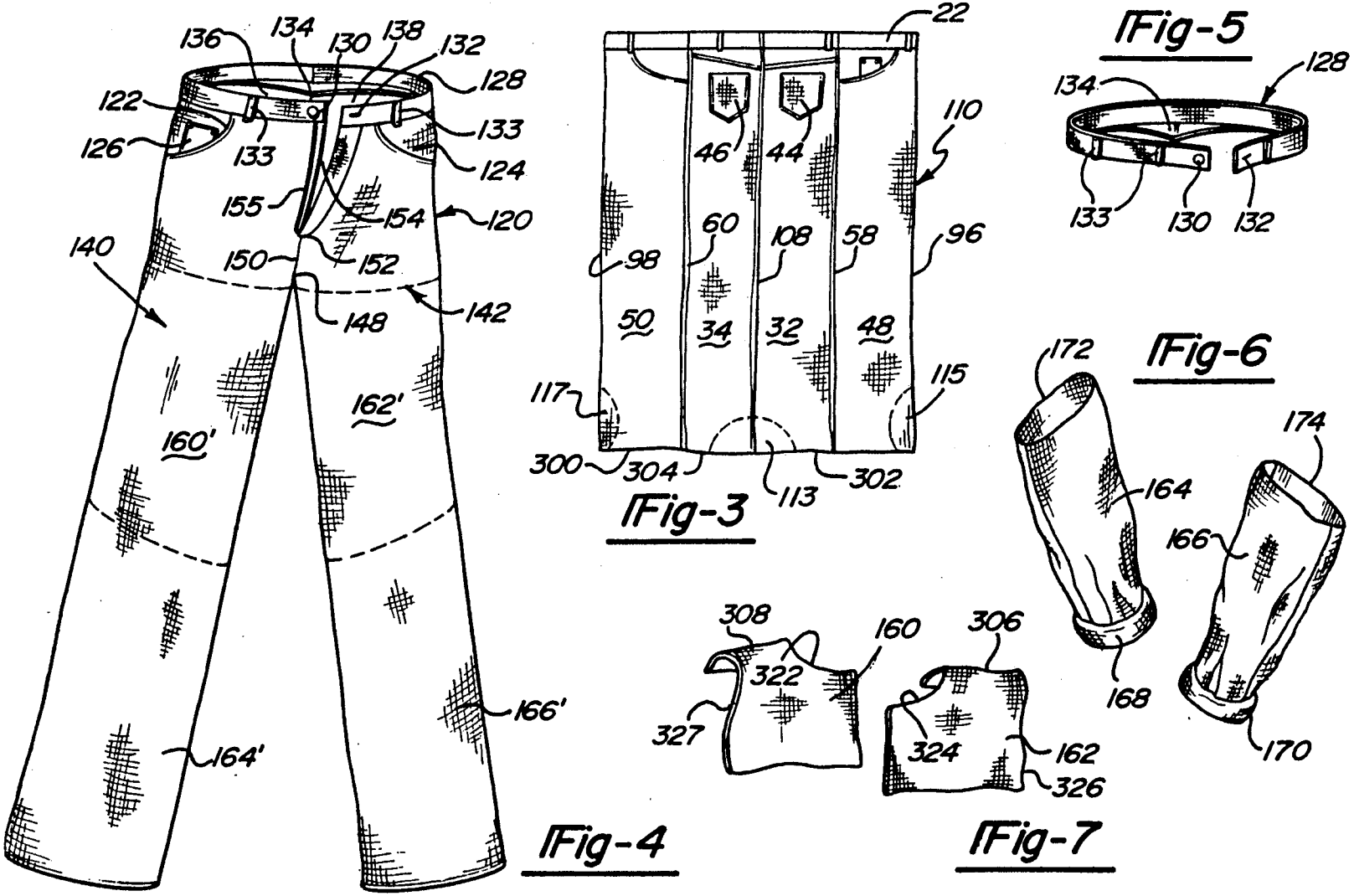
FIG. 3 is a plan view of a major panel for the jacket of this invention made from front and rear panels of FIG. 2.
FIG. 4 is a pictorial front view of a second pair of trousers.
FIG. 5 is a pictorial view of the waistband and yoke of the trousers of FIG. 4.
FIG. 6 is a pictorial view of a pair of arms for the jacket of this invention which are made from lower portions of the trouser legs of FIG. 4.
FIG. 7 is a plan view of a pair of upper front panels taken from the fabric of the FIG. 4 trousers used for the jacket of this invention.
Figure 13:
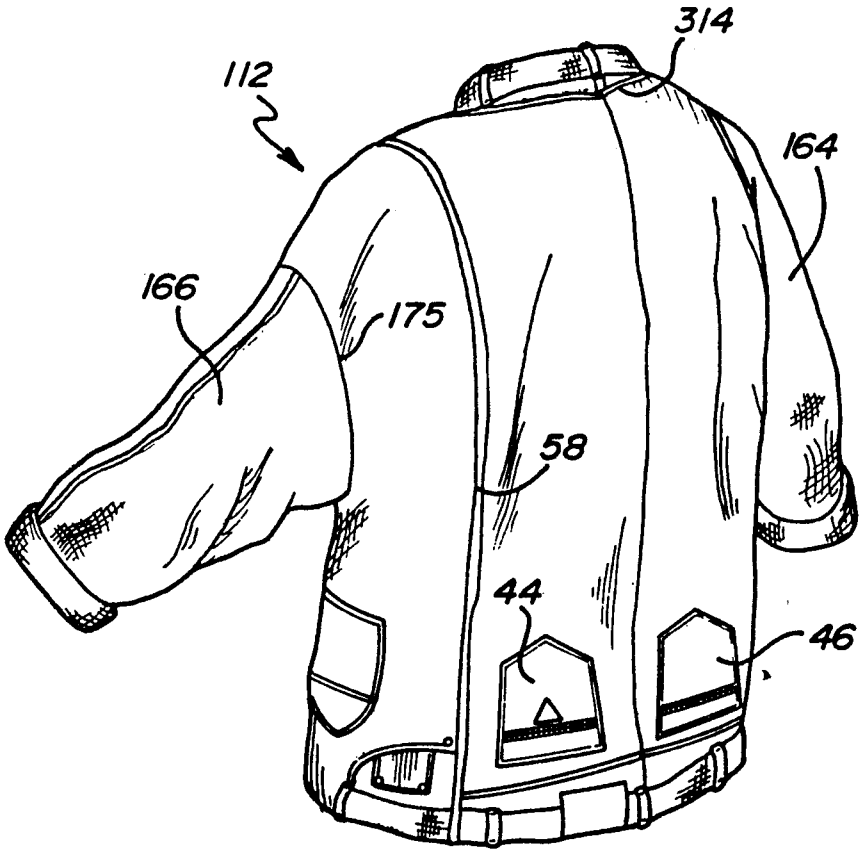
FIG. 13 is a pictorial view of the backside of the jacket of FIG. 12 made from the components taken from the three pairs of trousers.
Figure 12:
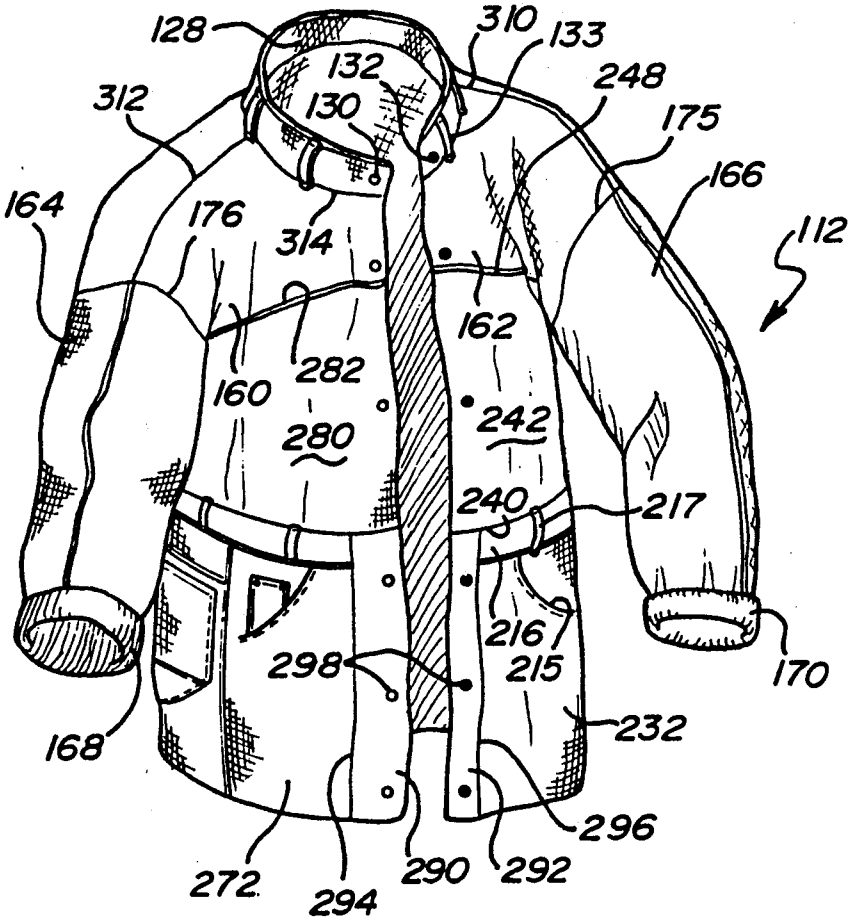
FIG. 12 is a pictorial view of the front portion of a jacket made from the trouser components of FIGS. 3 through 11.

Straight inner cut lines 100, 102 are chalked from the cuff end of the rear panels 32 and 34 inboard of inseams 52, 54 to the apex point 36 of the back yoke as shown in FIG. 2. Inside raw edges are then cut along these chalk lines and the surplus portions 104 and 106 are discarded. These raw edges are then sewn together to form the back seam 108 as illustrated in FIG. 3. With the completion of back seam 108 and with the outside raw side edges 96 and 98 cut along lines 88 and 90, the unitized back, sides and shoulder component 110 shown in FIG. 3 for the jean jacket 112 of FIGS. 12 and 13 is basically formed. This component has been marked with cut lines at 113, 115 and 117 for cutouts to be made therein for the collar and left and right sleeves as described below.

FIG. 4 illustrates a second pair of jeans 120 which preferably are the same in construction as jeans 20 with the front having conventional forward main pockets 122, 124 and watch pocket 126. These second jeans have a circular waistband 128 terminating in frontal button 130 and buttonhole 132 to allow the waistband to be buttoned together to maintain the garment on the body. These jeans also have belt carriers 133 and a two piece back yoke 134 affixed to the rear of the waistband to which rear panels 136 and 138 are sewn as described in connection with the jeans of FIG. 1. Front right and left panels 140 and 142 are seam sewn to the waistband and are attached to the rear panels by inner seams sewn from the lower legs to the crotch point 148. The front panels of the jeans are connected together by front seam 150 leading from the crotch point 148 up to the front bar stitch 152. From bar stitch 152 the jeans have frontal vertical opening 154 which can be closed by a conventional zipper 155 as with the jeans 20.

FIG. 5 shows the complete waistband 128 with rear yoke 134, carriers 133, front button 130 and buttonhole 132 as seam ripped and taken from the jeans of FIG. 4 and sewn in cutout at 113 for use as the collar for jacket 112.

FIG. 7 shows right and left front panels 160, 162 that may be cut from sections 160' and 162' of the front panels 140, 142 of the jeans 120. In FIG. 6 right and left side jacket arms 164, 166 are provided by cutting lengths 164' and 166' from lower portions of right and left legs of the jeans 120. The lower end of the arms 164, 166 are rolled up at 168 and 170 to form cuffs. The upper raw edges 172, 174 of these arms are stitched at seams 175, 176 to the arm cuts made at 117 and 115 in main panel 110 and the right and left front breast panels 160, 162 are seam stitched thereto at 175, 176.

Figure 9:
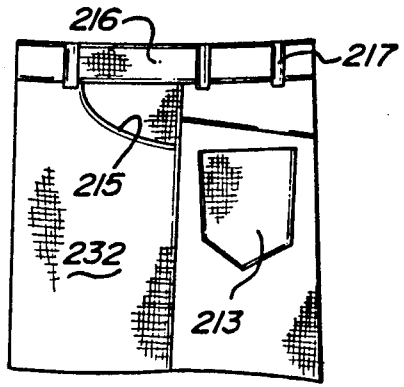
FIG. 9 is a view of the left front waist panel for the jacket of this invention.
Figure 11:
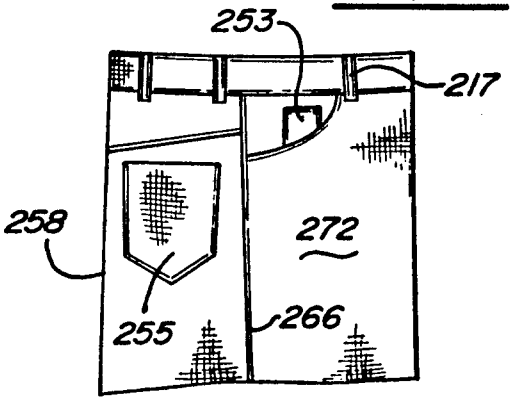
FIG. 11 is a view of the right front waist panel for the jacket of this invention.
Figure 8:
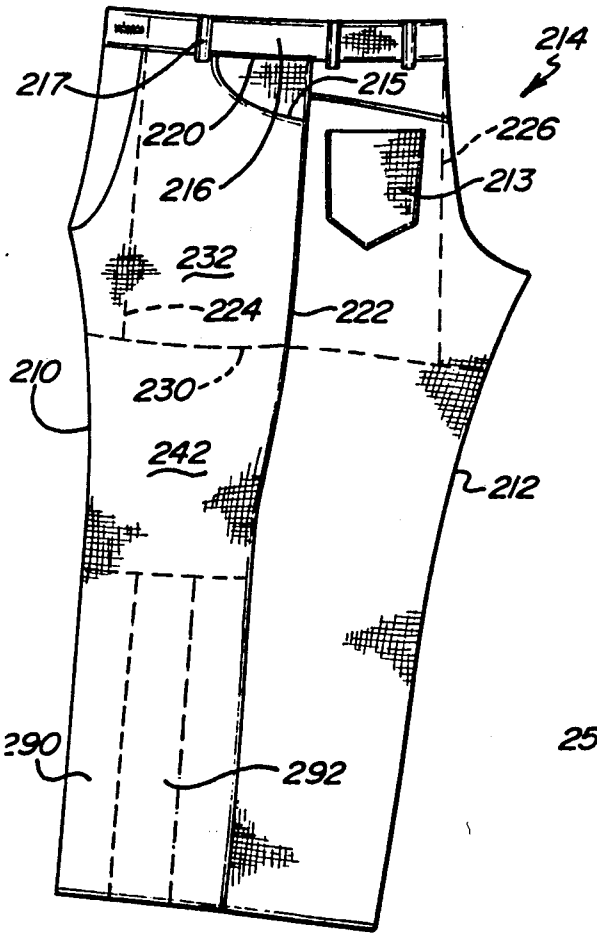
FIG. 8 is a left side view of a portion of the front and rear panels of another pair of trousers similar to those of FIG. 1.

FIG. 8 illustrates the front and rear panels 210, 212 of the left side of a third pair of jeans 214 with front pocket 215 and rear pocket 213. As with the other pairs of jeans, these panels are sewn to the associated waistband 216 with stays 217 at seam 220 and are connected to each other by outer seam 222. Vertical cut lines 224, 226 are established across the waistband 216 and the front panels as shown in FIG. 8. Horizontal cut line 230 established across the front and rear panels from vertical line 224 to the vertical line 222 provides the material for the lower left panel 232 of the jacket 112. Accordingly, after this panel is cut as shown in FIG. 9, the upper edge of waistband 216 is sewn to the lower edge 240 of a generally rectangular chest panel 242 cut from the front of the leg of the left front panel at 242' of the third pair of trousers. The top edge of panel 242 is sewn at seam 248 to the lower seam edge of the upper left front panel 162.

Figure 10:
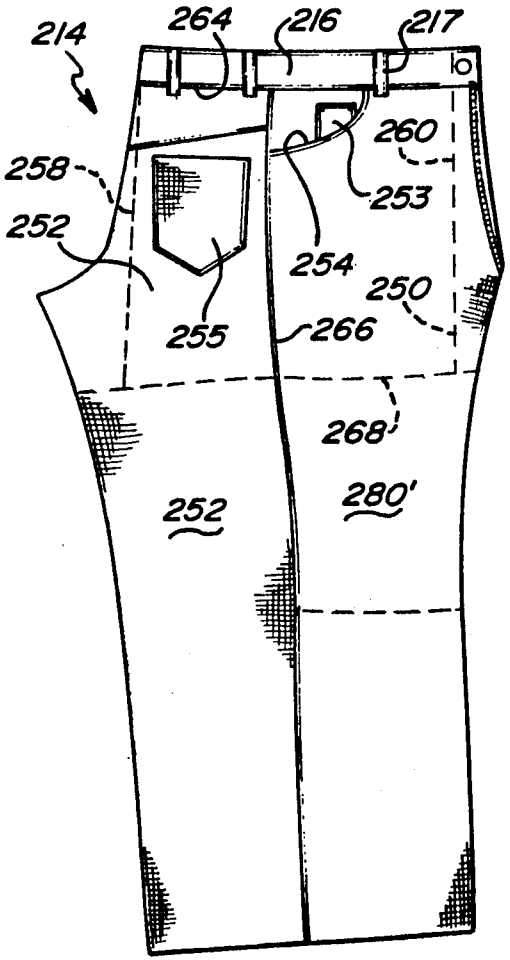
FIG. 10 is a right side view of the front and rear panels of the trousers of FIG. 8.

FIG. 10 illustrates the right side front and rear panels 250, 252 of the third pair of jeans 214 having watch pocket 253 immediately above front pocket 254 and a rear pocket 255. These panels are cut along vertical lines 258, 260 and horizontal cut line 268 to establish the lower right front 272 of the jacket 210. The lower right and left fronts may be tailored to adjust jacket girth and length as desired.

A generally rectangular front chest panel 280 is cut from the front panel 280 of the third pair of jeans or from any other panel containing sufficient fabric. The top edge of this panel is sewn at seam 282 to the lower edge of the upper front panel 160.

Vertical strips 290', 292' are cut from any convenient portion of the jeans such as from the lower end of the left front panel 210. These strips are sewn as front edge panels 290 and 292 to the vertical edges of the lower front panels 272 and 232 as shown in FIG. 12. These strips plus the adjacent of the front jacket panels carry suitable fasteners such as snap type fasteners 298 to close and open the front of the jacket 112.

FIGS. 12 and 13 show the preferred design and assembly of the jean jacket 112. Initially, the main component 110 is laid out and cut as in FIG. 3 to form the back and side portions of the jacket. The lower side edges 302 and 304 of panels 32 and 34 of component 110 are sewn respectively to the upper edges 306 and 308 of the upper front panels 160, 162 to form the left and right jacket shoulder seams 310 and 312. The waistband 128 of FIG. 5 is sewn at seam 314, curved edge of cutout 113 of component 110 and to the cutout edges 322 and 324 to form the jacket collar with the stays 133 attached and with existing front button 130 and buttonhole 132 in place. The left sleeve 166 is sewn at seam 175 to the left sleeve cutout 115 of panel 110 and cut out 326 of panel 162. The right sleeve 164 is similarly sewn at seam 176 to the right sleeve cutouts 117 of panels 110 and 327 of panel 160. Any open seams not specifically shown or described are sewn to complete the jacket.

It will be understood that the above described embodiments are illustrative of the invention which may be modified within the scope of the appended claims.

The embodiments of the invention in which an exclusive property or privilege is claimed are defined as follows:

1. A method of making a jacket having a body portion made from a plurality of panels, said panels formed from pairs of trousers, said panels terminating in discrete side edges normally adjacent to one another to define an elongated access opening, a discrete neck opening and left and right arm sleeves attached to said body portion, comprising the steps of:

separating seam portions of a first pair of trouser's (trousers having) leg portions and a waistband, laying out the trousers in a generally flattened configuration, cutting two adjacent inseam edges so that excess inseam portions are removed, (they are substantially straight,) cutting (the) outside edges of said (the) trouser (trousers) panels, in a substantially parallel trajectory, to said cut inseam side edges, sewing the separated (ripped) inseam edges together to form (the) back panels and side panels of said jacket with said waistband at the lower edge of said jacket, making (a) curved cutout into the upper edges of said back panels, removing a waistband from a second pair of trousers and sewing (attaching) said removed waistband to said curved cut out (opening) to form a collar for said jacket.

2. A method of making a jacket to be worn by a person from a plurality of pairs of trousers each having a waistband, a pair of elongated front panels extending from sewn connection with said waistband to terminal ends, a pair of elongated rear panels extending from sewn connection with yoke means and said waistband to terminal edges, sewn seam means extending from said waistband to a crotch point between said waistband and said terminal lower edge to connect overlying side edges of an upper portion of said rear panel to form the seat of said trousers second sewn seam means extending from said crotch point to said lower terminal edge of said panels to form an inseam for one of the legs of said trousers, third seam means extending from said crotch point to the lower terminal edge of said trousers, said trousers having a fly opening therein from which said waistband extends to a terminus above said crotch point to allow a person to dress into said trousers, fastener means for selectively closing said fly means, first inseam means for connecting said front panel to one of said other panels to form one of said legs, second inseam means for connecting said front panel means to said second rear panel to form the other of said legs, comprising the steps of:

ripping the inner seams of one of said pairs of trousers and laying the ripped parts out to form a generally flat component, cutting said inner seams and sewing them together to form a generally rectangular component, cutting a generally centralized curved opening into the center of said component to form an opening for a neck of said jacket, removing the waistband of a second pair of trousers, sewing said waistband into said curved cut out (opening) to form a neck collar for said jacket, removing a portion of the legs of a second pair of trousers, for left and right front chest panels, and respectively sewing said panels to the upper edges of said back and to said neck opening, cutting lower portion of said second pair of trousers and sewing them to back and front panels to form the arms of said jacket, removing the waistband along with portions of left and right front leg panels from a third pair of trousers, sewing waistband and left and right front leg panels to chest and side panels to thereby form said jacket.

3. A jacket having back and opposite side panels sewn together from the four main panels of a first pair of trousers, a collar portion fabricated from the waistband of a second pair of trousers sewn to a portion of the main panel, left and right arms formed by cutting off lower portion of legs of a second pair of trousers, and front panels cut from the right and left leg upper portions of said second pair of trousers and sewn to shoulder portions of said jacket, and left and right front panels of a third pair of trousers sewn to said front panels.

4. A jacket having back and side panels formed from four back and front main panels of a first pair of trousers, a neck collar portion fabricated from the waistband of a second pair of trousers sewn to a bottom portion of the back main panels, left and right arms formed from the legs of a second pair of trousers, sewn to opposite sides of said front main panels of said first pair of trousers, said jacket having front panels cut from portions of said second pair of trousers and sewn to the ends of the upper portions of said front panels to form front portions of said jacket, and left and right front lower jacket panels from the left and right front panels of a third pair of trousers sewn to the bottom of the front portion of said jacket.

* * * * *